US005958149A

United States Patent [19]

Callaghan et al.

[11] Patent Number: 5,958,149

[45] Date of Patent: Sep. 28, 1999

[54] METHOD OF CLEANING SURFACES, COMPOSITION SUITABLE FOR USE IN THE METHOD, AND OF PREPARING THE COMPOSITION

[75] Inventors: Ian C. Callaghan, Wokingham; Balvinder Adat, Camberley; Judith A. Freeman, Godalming, all of United Kingdom

[73] Assignee: S. C. Johnson & Son, Inc., Racine, Wis.

[21] Appl. No.: 09/156,779

[22] Filed: Sep. 17, 1998

[51] Int. Cl.[6] ..... C11D 7/50; C11D 7/26

[52] U.S. Cl. ..... 134/38; 510/505; 510/506; 510/421; 510/241; 510/242

[58] Field of Search ..... 134/40, 38; 510/505, 510/407, 365, 506, 175, 200, 201, 245, 413, 241

[56] References Cited

U.S. PATENT DOCUMENTS

| | | | |
|---|---|---|---|
| 4,414,128 | 11/1983 | Goffinet . | |
| 4,511,488 | 4/1985 | Matta . | |
| 4,640,719 | 2/1987 | Hayes et al. . | |
| 4,673,524 | 6/1987 | Dean | 252/118 |
| 4,704,225 | 11/1987 | Stoufer . | |
| 4,780,235 | 10/1988 | Jackson | 252/170 |
| 4,867,800 | 9/1989 | Dishart et al. . | |
| 4,869,842 | 9/1989 | Denis et al. . | |
| 4,934,391 | 6/1990 | Futch et al. . | |
| 5,030,290 | 7/1991 | Davis . | |
| 5,062,988 | 11/1991 | Dishart et al. . | |
| 5,084,200 | 1/1992 | Dishart et al. . | |
| 5,196,136 | 3/1993 | Dishart et al. . | |
| 5,213,624 | 5/1993 | Williams . | |
| 5,246,503 | 9/1993 | Minick . | |
| 5,415,800 | 5/1995 | Motsenbocker . | |
| 5,427,710 | 6/1995 | Stevens . | |
| 5,484,487 | 1/1996 | Motsenbocker | 134/6 |
| 5,877,133 | 3/1999 | Good | 510/175 |
| B1 4,867,800 | 2/1995 | Dishart et al. . | |

FOREIGN PATENT DOCUMENTS

| | | |
|---|---|---|
| 95/27757 | 10/1995 | WIPO . |

*Primary Examiner*—Yogendra Gupta
*Assistant Examiner*—Gregory E. Webb

[57] ABSTRACT

A liquid cleaning composition is disclosed that is suitable for cleaning strippable surface. It has an ester solvent with a Hansen solubility parameter in the range of 9.5 to 11 which is present in amount of 3.0% to 7.2% by weight based on the total weight of the composition. There is also a surfactant system in an amount of 3.5% to 7.5% by weight of active material based on the total weight of the composition. The system has a natural soap and a nonionic surfactant; an abrasive in an amount of 0.5% to 4.0% by weight based on total weight of the composition; and at least 70% by weight of water based on total weight of the composition. Methods of using and preparing the composition are also described.

4 Claims, No Drawings

METHOD OF CLEANING SURFACES, COMPOSITION SUITABLE FOR USE IN THE METHOD, AND OF PREPARING THE COMPOSITION

CROSS REFERENCES TO RELATED APPLICATIONS

Not Applicable

STATEMENT REGARDING FEDERALLY SPONSORED RESEARCH

Not Applicable

The present invention relates to methods of cleaning coated surfaces, to compositions suitable for use in the methods, and to methods of preparing the compositions.

Hard surfaces with a coating are used in a variety of situations where they can become soiled. Some coatings are hard by nature and are resistant to abrasion and solvents. Thus, vitreous enamel coatings on cooking stoves can be cleaned with abrasives or with a variety of solvents having a strong dissolving action on oils and grease. However, in the domestic and office environment many surfaces coated with varnishes and paints become soiled, with cigarette smoke or other air-borne contaminants, and with grease and food debris. The resulting soil can be difficult to remove.

A harsh abrasive cleaner will damage many surface coatings, as will many solvents. Indeed, some solvents and mixtures of solvents are used in paint stripping liquids. The use of organic solvents may also not be acceptable in the domestic or office environment if high concentrations of solvent vapor are produced.

It is desirable to be able to use a single cleaning product on various types of paints and varnishes found around the home. However, water-based paint systems are highly susceptible to damage from aqueous or solvent based cleaners. Oil-based paints are more robust. Much of the discoloration of oil-based paints occurs as a result of deterioration of the pigment close to the film surface. We have found that this can be treated with a mildly abrasive product. However, the incorporation of abrasives into liquid systems gives rise to problems if a homogeneous liquid is to be obtained.

It can therefore be seen that there is a need for a liquid composition which provides effective cleaning of painted and varnished surfaces without damaging the paint or varnish. It is desirable for such a liquid composition to remain homogeneous under normal storage conditions, in order to prevent important ingredients settling out so as to avoid the formation of liquid phases having insufficient or excess activity.

BRIEF SUMMARY OF THE INVENTION

One aspect of the present invention provides a method of cleaning a surface coated having a strippable surface coating. One brings the surface into contact with a liquid cleaning composition that has:

a) an ester solvent that has a Hansen solubility parameter in the range 9.5 to 11 which is present in an amount which is 3.0% to 7.2% by weight based on total weight of composition, b) a surfactant system in an amount in the range 3.5% to 7.5% by weight of active material based on the total weight of composition, the system having a natural soap and a nonionic surfactant, c) an abrasive in an amount which is 0.5% to 4.0% by weight based on total weight of composition, and d) at least 70% by weight of water based on total weight of composition.

According to a further aspect of the present invention there is provided the above liquid cleaning composition.

In another aspect there is provided a process for preparing a liquid cleaning composition suitable for cleaning strippable surface coatings. It includes the successive steps of forming a natural soap at an elevated temperature in an aqueous medium by reaction of a fatty acid derivative with an alkali; adding in any sequence the ester solvent and a nonionic surfactant; and producing a stable dispersion of abrasive particles in the aqueous medium by adding abrasive particles at a controlled rate to the aqueous medium with agitation while allowing the liquid to cool from the elevated temperature. The amounts of ingredients are selected to yield a liquid cleaning composition as described above.

The method of cleaning can be applied to surfaces coated with strippable surface coatings. By "strippable" surface coating we mean a coating which is removed or softened when left in contact with methylene chloride. In this regard, most paints and varnishes applied in situ in homes and offices are strippable.

The composition may be applied to the surface to be cleaned by spraying, and may be removed from the surface subsequently by rinsing with water. Preferably the composition is applied to the surface to be cleaned by bringing an absorbent solid article (e.g. a sponge or a cloth) containing the composition into contact with the surface. Also preferably, manual pressure is applied to the absorbent solid during the application of the composition to the surface.

The ester solvent has a Hansen solubility parameter in the range 9.5 to 11, preferably 9.8 to 10.2. Hansen solubility parameter is a well-known method of characterizing solvents. It is discussed in Kirk-Othmer Encyclopedia of Chemical Technology, suppl. Vol.; 2nd Edition, 1971, p.889ff. Methods for determining the solubility parameters are given in ASTM D3132-84.

The ester solvent may be a single ester or a mixture of esters. Preferably the ester is a dialkyl (e.g. dimethyl) ester of a low molecular weight dibasic organic acid, e.g. having a molecular weight of from 60 to 250. It is particularly preferred to use dimethyl esters of glutaric, succinic, and adipic acids, in particular a mixture of the above acids in the weight ratio 3:2:1.

The ester solvent is present in the formulation in an amount in the range 3.0% to 7.2% by weight based on the weight of total composition. The composition preferably contains an additional organic solvent which may be a terpene or a glycol ether and may be in an amount in the range 0.5% to 2.5% by weight based on total weight of composition.

Examples of terpenes suitable for use in the present invention are d-limonene, orange terpenes. Examples of glycol ethers suitable for use in the present invention are propylene glycol methyl ether, dipropylene glycol methyl ether. Examples of glycol ethers are those sold under the trade names "Dowanol P" and "Dowanol E" by the Dow Chemical Company. The "P" series glycol ethers are derived from propylene glycol and the "E" series glycol ethers are derived from ethylene glycol.

The quantity of the terpene or glycol ether solvent is in the range 0.5% to 2.5% by weight based on the total weight of the composition, preferably 1.0 to 2.0% by weight. The composition contains a surfactant system in an amount in the range 3.5% to 7.5% by weight based on total weight of composition. Commercially available surfactant often contain inactive material and the weight percentages given above are based on active material in the product as sold. The surfactant system contains a natural soap and a nonionic surfactant. Preferably it also contains an alkyl sulphate.

The natural soap may be an alkali metal, ammonium or polyalkyl ethanolamine salt of a naturally occurring fatty acid. Such soaps may be obtained by the hydrolysis of naturally occurring fatty acid triglycerides (e.g. coconut oil or tallow) with caustic soda or caustic potash and neutralization of the fatty acids released by hydrolysis. It may be formed in situ in the composition by including appropriate amounts of triglyceride and alkali in the composition.

The nonionic surfactant may for example be an ethoxylate of a linear alkanol. Preferably the alkanol has an average chain length in the range 9–11. It preferably contains an ether chain corresponding to reaction with 2 to 11, e.g. 3, molecules of ethylene oxide per molecule of alkanol.

The alkyl sulphate surfactant, if present, preferably has a carbon chain with an average chain length of from 10 to 18 carbon atoms, more preferably 10 to 14 carbon atoms. The alkyl chain is preferably a straight chain derived from natural sources. The alkyl sulphate salt is preferably a sodium, potassium, ammonium or an alkanolamine salt.

The natural soap is preferably the main component of the surfactant system. Thus the surfactant system preferably contains at least 4 parts of soap per part of nonionic surfactant by weight, more preferably at least 3 parts per part of nonionic surfactant by weight. The nonionic surfactant is preferably present in an amount not greater than 3 parts by weight per part by weight of alkyl sulphate. The total amount of surfactant is in the range 3.5% to 7.5% by weight based on the total weight of composition.

The composition may contain abrasive particles. The abrasive particles must be of such hardness that they do not damage a strippable surface coating of normal abrasion resistance, but will nevertheless remove surface layers of discolored pigment. Preferably the hardness is not greater than 5 on Moh's scale of hardness. Examples of suitable abrasive particles are smectite clays, kaolinite clays, talc, ptfe, and hydrated salts. The preferred abrasives are clays and hydrated salts, e.g. sodium bicarbonate. The amount and water solubility of any hydrated salt used will be such as to give a solid in the composition. The amount of abrasive present is from 0.5% to 4.0%, preferably from 1% to 3% by weight based on total weight of composition.

The composition may contain fragrances, dyes, pigments, bleaches or other components normally found in detergent compositions. The amount of water present in the composition is not less than 70% by weight of the total composition.

In the process for the preparation of the composition of the present invention, the initial stage of forming the natural soap is preferably carried out at a temperature in the range 50° C. to 70° C., preferably 55° C. to 65° C. The solvent is preferably added as a pre-formed mixture with a nonionic surfactant.

DETAILED DESCRIPTION

EXAMPLE 1

A composition (total weight 500 g) was prepared from the ingredients set out below.

| Ingredient | % wt |
|---|---|
| Deionized water | 77.37 |
| Fatty acid | 6.00 |
| NaOH % solution | 2.00 |
| Anionic surfactant | 1.53 |
| Nonionic surfactant 1 | 0.60 |
| Abrasive 1 | 3.00 |
| Pre-mix | 8.00 |
| Terpene | 1.50 |

The composition of the pre-mix was (percentage by weight)

| | |
|---|---|
| Solvent | 80.00 |
| Nonionic surfactant 2 | 20.00 |

The fatty acid was a commercially product available from Unichema International Limited, Wirral under the trade name "Prifac 7901". It was a distilled coconut fatty acid containing $C_8$–$C_{18}$ saturated and $C_{18}$ unsaturated straight chain fatty acid with $C_{12}$ fatty acid as the largest single component. The fatty acid reacts with the NaOH to give a natural soap. The NaOH solution was an aqueous solution containing 47% by weight of NaOH.

The anionic surfactant was a commercial product available from Albright & Wilson, Oldbury under the trade name Empicol LZV. It was a sodium salt of a $C_{12}$–$C_{18}$ alkyl sulphuric acid and had a mean molecular weight of 303.

Nonionic surfactant 1 was a commercial product available from Albright & Wilson, Oldbury under the trade name "Empigen OB". It was an alkyl dimethylamine oxide with the alkyl group containing 10 to 16 carbon atoms, and predominantly containing 12 to 14 carbon atoms.

Abrasive 1 was a finely divided kaolinite clay commercially product available from Chemintech, St Austell under the trade name "Claycote". The material is sold as a thickener but it should be noted that the increased viscosity required to keep the clay in suspension was provided by the surfactants used and not by the clay.

The solvent used in the pre-mix was a commercial solvent available from Chemoxy International plc, Middlesbrough under the trade name "Estasol". This was a mixture of dimethyl esters of succinic, glutaric, and adipic acid, having a melting point of −25° C. and a boiling point of 200–230° C. at 760 mm Hg. It had a Hansen Solubility Parameter of 10.1.

Nonionic surfactant 2 used in the preparation of the pre-mix was a fatty alcohol ethoxylate sold under the trade name Synperonic A3 by ICI Surfactants, Middlesbrough. The terpene used was d-limonene.

The composition was prepared as follows. The pre-mix was prepared by stirring together the ingredients at ambient temperature. The water was introduced into a reactor with a stirrer and heated to 60° C. The fatty acid was pre-heated to 60° C. and mixed with the water.

The NaOH was then added and the mixture was stirred for ca. 15 minutes at 60° C. The anionic surfactant and the non-ionic surfactant 1 were then added, followed by the pre-mix. The abrasive was added with stirring while the reactor was allowed to cool to ambient temperature.

Paint Cleaning Evaluation

Four areas of plaster board were coated with four different types of paint. The four paints used were 1) "Dulux" (Trade name) Gloss paint, Brilliant White, Finishing touches 2) "Great Mills" (Trade name) High Performance One Coat 3) "Great Mills (Trade name) High Performance Satin Finish 4) "Dulux" (Trade name) Trade, Low Odour Egg shell.

Two coats of each paint were applied to the plasterboard surface. The boards were left in a room heated to 35° C. Each painted area was then divided into 8 sections widthways and soiled with 7 different soils, namely 1) permanent marker, 2) used car oil, 3) pencil, 4) tea, 5) gravy, 6) blue biro, and 7) tomato ketchup.

A cloth was impregnated with the composition prepared as above and was rubbed over a stained area of the test panels for a fixed period of time. The amount of soil removed was evaluated visually on a scale from 1 to 5, where 1 signifies that very little of the soil was removed and 5 signifies that most of the soil was removed. The results are shown in the following tables.

EXAMPLE 2

A composition (total weight 500 g) was prepared as in Example 1 from the ingredients set out below.

| Ingredient | % wt |
|---|---|
| Deionized water | 79.00 |
| Fatty acid | 6.00 |
| NaOH % solution | 2.00 |
| Abrasive 2 | 3.00 |
| Pre-mix | 10.00 |

Abrasive 2 was a dispersion of kaolinite clay commercially available as QPC. The composition was evaluated as in Example 1. The results are shown in the tables.

Comparative Test A

This is a comparative test not according to the invention. A composition was prepared as in Example 1 but without the previous preparation of a pre-mix and using previously prepared natural soap. It had the following composition.

| Ingredient | % wt |
|---|---|
| Deionized water | 89.58 |
| Sodium stearate | 1.28 |
| Anionic surfactant | 1.53 |
| Nonionic surfactant 1 | 0.60 |
| Sodium sulphate | 1.11 |
| I.D.A. acid | 0.90 |
| Abrasive 3 | 5.00 |

I.D.A. acid is bis-(carboxymethyl) amine and is also known as iminodiacetic acid. Abrasive 3 is a finely divided magnesium aluminosilicate commercial product available from R T Vanderbilt & Co under the trade name "Veegum Ultra". The results of evaluation as in Example 1 are shown in the tables.

Comparative Test B

An aqueous solution of a conventional solid paint cleaning material known as "sugar soap" and sold under the trade name "Great Mills" was prepared in accordance with the instructions on the packet. It was evaluated as in Example 1 and the results are given in the tables.

TABLE 1

"Dulux" Gloss Paint Finishing Touches

| Soil | Test B Sugar soap | Example 1 | Example 2 | Test A |
|---|---|---|---|---|
| 1 | 1 | 2 | 3 | 1 |
| 2 | 1 | 4 | 3 | 2 |
| 3 | 3 | 5 | 4 | 3 |
| 4 | 2 | 4 | 5 | 3 |
| 5 | 2 | 4 | 4 | 3 |
| 6 | 1 | 3 | 3 | 1 |
| 7 | 4 | 5 | 5 | 5 |
| Total | 14/35 | 27/35 | 27/35 | 18/35 |
| % Removal | 40 | 77.1 | 77 | 51.4 |

TABLE 2

"Great Mills" High Performance One Coat

| Soil | Test B | Example 1 | Example 2 | Test A |
|---|---|---|---|---|
| 1 | 1 | 2 | 1 | 1 |
| 2 | 2 | 4 | 4 | 3 |
| 3 | 2 | 1 | 1 | 2 |
| 4 | 3 | 5 | 5 | 4 |
| 5 | 2 | 4 | 5 | 3 |
| 6 | 1 | 1 | 2 | 0 |
| 7 | 4 | 5 | 5 | 5 |
| Total | 15/35 | 24/35 | 22/35 | 20/35 |
| % Removed | 42.9 | 63 | 57.5 | 57.1 |

TABLE 3

"Great Mills" High Performance Satin Finish

| Soil | Test B | Example 1 | Example 2 | Test A |
|---|---|---|---|---|
| 1 | 2 | 2 | 3 | 2 |
| 2 | 2 | 2 | 3 | 2 |
| 3 | 1 | 4 | 3 | 2 |
| 4 | 3 | 2 | 2 | 2 |
| 5 | 4 | 3 | 3 | 2 |
| 6 | 1 | 1 | 2 | 1 |
| 7 | 5 | 4 | 5 | 5 |
| Total | 18/35 | 18/35 | 22/35 | 16/35 |
| % Removed | 51.4 | 51.4 | 57.1 | 45.7 |

TABLE 4

"Dulux" Trade Low Odour Eggshell

| Soil | Test B | Example 1 | Example 2 | Test A |
|---|---|---|---|---|
| 1 | 1 | 1 | 1 | 1 |
| 2 | 2 | 1 | 3 | 4 |
| 3 | 1 | 3 | 4 | 1 |
| 4 | 4 | 3 | 3 | 3 |
| 5 | 2 | 2 | 3 | 2 |
| 6 | 1 | 1 | 1 | 1 |
| 7 | 4 | 5 | 5 | 5 |
| Total | 15/35 | 16/35 | 20/35 | 17/35 |
| % Removed | 42.9 | 45.7 | 57.1 | 48.6 |

INDUSTRIAL APPLICABILITY

The compositions and methods of the present invention are applicable to the desirable result of cleaning soiled paint and varnish surfaces. They make possible the production of homogeneous liquid products containing abrasives which may be used on surfaces coated with water-based paints as well as on surfaces coated with oil-based paints.

What is claimed is:

1. A method of cleaning a surface coated with a strippable surface coating, the method comprising bringing the surface into contact with a liquid cleaning composition, the composition comprising:

(a) an ester solvent having a Hansen solubility parameter in the range of 9.5 to 11 which is present in an amount of 3.0% to 7.2% by weight based on the total weight of the composition;

(b) a surfactant system in an amount of 3.5% to 7.5% by weight of active material based on the total weight of the composition, said system comprising a natural soap and a nonionic surfactant;

(c) an abrasive in an amount of 0.5% to 4.0% by weight based on total weight of the composition; and (d) at least 70% by weight of water based on total weight of the composition.

2. The method of claim 1, wherein the composition is applied to the surface in an absorbent solid article.

3. The method of claim 2, wherein manual pressure is applied to the absorbent solid during the application of the composition to the surface.

4. The method of claim 1, wherein the nonionic surfactant is an ethoxylate of linear alcohol.

* * * * *